United States Patent [19]

Hackney

[11] Patent Number: 4,561,373

[45] Date of Patent: Dec. 31, 1985

[54] PROTECTIVE CAPS FOR SAILBOAT SPREADERS

[76] Inventor: John Hackney, 1026 NW. 16th St., Stuart, Fla. 33494

[21] Appl. No.: 602,138

[22] Filed: Apr. 19, 1984

[51] Int. Cl.[4] ..... B63H 9/10

[52] U.S. Cl. ..... 114/89; 114/97; 114/102

[58] Field of Search ..... 114/89, 90, 92–97, 114/100, 101, 102; 411/513–515

[56] References Cited

U.S. PATENT DOCUMENTS 3,477,402 11/1969 Le Compte ..... 114/102
4,086,014 4/1978 Talaguier ..... 411/514

FOREIGN PATENT DOCUMENTS 409573 4/1968 Australia ..... 114/90

*Primary Examiner*—Sherman D. Basinger
*Attorney, Agent, or Firm*—Carroll F. Palmer

[57] ABSTRACT

Protective caps for the ends of sailboat spreaders comprise an arcuate outer surface over which a sail or line may pass without being snagged, an opening sized to snugly fit over the end of the spreader, a slot arrangement to permit the cap to fit over a shroud that runs through the end of the spreader and bores in the cap normal to the slot arrangement into which a cotter pin may be inserted to hold the cap onto the spreader end.

3 Claims, 7 Drawing Figures

PROTECTIVE CAPS FOR SAILBOAT SPREADERS

BACKGROUND OF THE INVENTION

1. Field of the Invention

This invention relates to devices for preventing the ends of spreaders on sailboats from being entangled with sails or lines carried by the sailboat. More particularly, it concerns molded plastic caps to be fitted on the outer end of sailboat spreaders.

2. Description of the Prior Art

Spreaders are used on sailboats in conjunction with shrouds to function as truss members to give lateral support to masts carried by sailboats. The spreaders present a problem in operation of the sailboats because sails come into contact with them on certain points of sail, e.g., when the boat beats to windward. Hence, the sail is subject to wear through contact with the ends of the boats spreaders. Also, if the sail in making such contact does not move freely over the spreader end, the sail may be torn and/or the spreader may be displaced or damaged.

A number of schemes have been used to mitigate the above mentioned spreader problem. For example, boat owners frequently use adhesive tape to cover the ends of spreaders to create a spreader end surface more compatible with sails or lines that may pass thereover.

Another system is to place rollers on the shrouds that rest on the upper surface of the spreader and extend a short distance beyond the spreader end. Hence, a sail that might otherwise contact the spreader end is held away from it by the roller.

Yet another system is to provide caps generally formed of rubber or the like that fit over the ends of spreaders and cover a small portion of the shrouds above and below the spreader.

Notwithstanding these prior schemes for trying to solve the mentioned sailboat spreader problem, further improvements are needed for this purpose, particularly for use on small sailboats where weight aloft can be critical and ease of installation of the protective device is an important consideration.

OBJECTS

A principal object of this invention is the provision of new devices for use on sailboat spreaders to mitigate possible entanglement of the spreader with sails or lines carried by the sailboat.

Further objects include the provision of:

1. New forms of protective caps for the ends of sailboat spreaders.
2. Such caps that are light in weight while being structurally strong and highly effective for their intended purpose.
3. Such caps that may be easily installed on a sailboat without need to remove or displace a shroud that passes through the end of the spreader on which the cap is to be placed.
4. Such caps that serve as an anti-snag device for a cotter pin that may be used as a fastener element on the end of a sailboat spreader.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The stated objects are accomplished according to the invention by the provision of protective caps for the end of a sailboat spreaders which comprise an opening in the rear of the cap of a size such that the cap will fit snugly over the spreader end, an arcuate surface on the front of the cap, a first slot in one side of the cap that extends from the outer surface of the cap into the opening, and a second slot in the side of the cap opposite to the first slot, the second slot extending from the outer surface of the cap into the opening, the longitudinal axes of the first and second slots being aligned. The first and second slots provide a space into which a shroud carried on the end of the spreader may enter so the cap may fit over the end of the spreader.

There is a first bore through a side of the cap that extends from the outer surface of the cap into the opening, the longitudinal axis of the first bore being normal to the longitudinal axes of the slots and there is a second bore through a side of the cap that extends from the outer surface of the cap into the opening, the longitudinal axis of the second bore being normal to the longitudinal axes of the slots and aligned with the longitudinal axis of the first bore. There is a chamfer on the outer end of the second bore and the first and second bores provide a passage through which a cotter pin may be inserted and retained by expanding the legs of the cotter pin in the chamfer.

BRIEF DESCRIPTION OF THE DRAWINGS

A more complete understanding of the invention may be obtained by reference to the accompanying drawing in which.

DETAILED DESCRIPTION OF PREFERRED EMBODIMENTS

Figure 1:
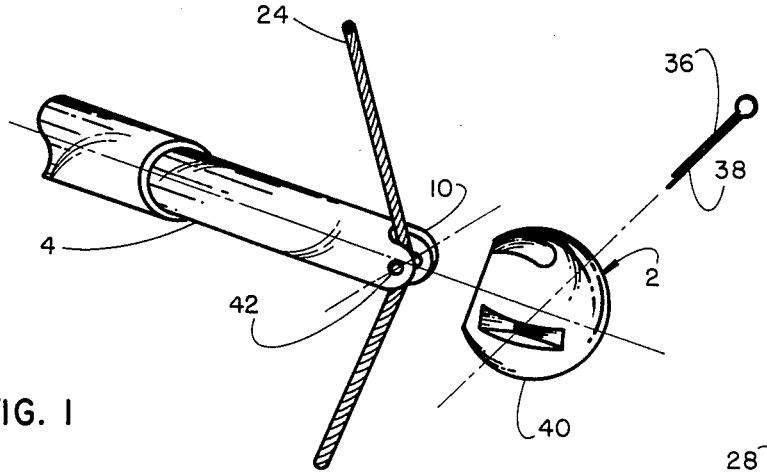
FIG. 1 is fragmentary, exploded, isometric view of the end portion of a sailboat spreader equipped with a protective cap of the invention.
Figure 2:
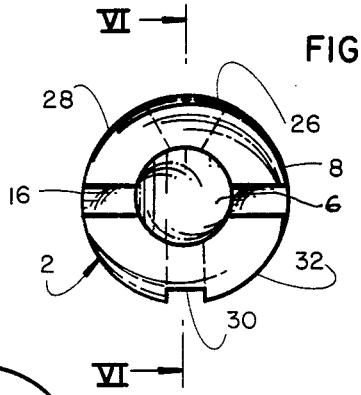
FIG. 2 is plan view of the rear end of a protective cap of the invention.
Figure 3:
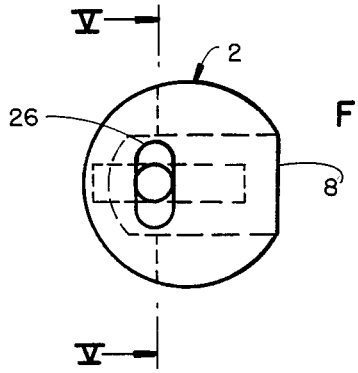
FIG. 3 is a lateral view of the cap of FIG. 2.
Figure 4:
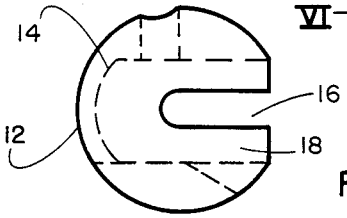
FIG. 4 is a lateral view of the cap of FIG. 2 turned 90° to the view of FIG. 3.
Figure 5:
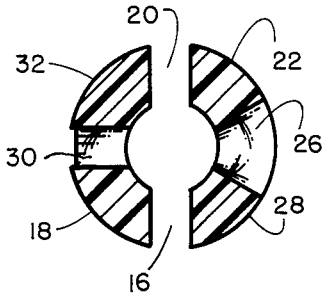
FIG. 5 is a sectional view taken on the line V—V of FIG. 3.
Figure 6:
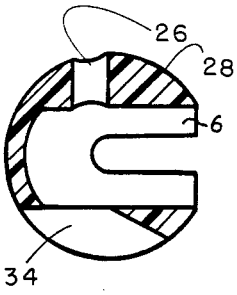
FIG. 6 is a sectional view taken on the line VI—VI of FIG. 2.

Referring in detail to the drawings, the protective cap 2 for the end of a sailboat spreader 4 comprises an opening 6 in the rear 8 of cap 2 of a size such that said cap will fit snugly over the spreader end 10.

There is an arcuate surface 12 on the front 14 of cap 2. A first slot 16 in one side 18 of cap 2 extends from the outer surface of the side 18 into the opening 6.

A second slot 20 in the side 22 of the cap 2 opposite to the first slot 16 extends from the outer surface of side 22 into the opening 6. The longitudinal axes of the first slot 16 and second slot 20 are aligned.

The first and second slots provide a space into which a shroud 24 carried on the end of the spreader 4 may enter so the cap 2 may fit over the end 10 of the spreader 4.

There is a first bore 26 through the side 28 of the cap 2 that extends from the outer surface of side 28 into the opening 6. The longitudinal axis of the first bore 26 is normal to said longitudinal axes of the slots 16 and 20.

A second bore 30 extends through the side 32 of the cap 2 from the outer surface of the side 32 into the opening 6. The longitudinal axis of the second bore 30 is normal to the longitudinal axes of the slots 16 and 20. The second bore 30 is aligned with the longitudinal axis of the first bore 16, There is a chamfer 34 on the outer end of the second bore 30 and the first and second bores provide a passage through which a cotter pin 36 may be inserted and retained by expanding its legs 38 in the chamfer 34.

Figure 7:
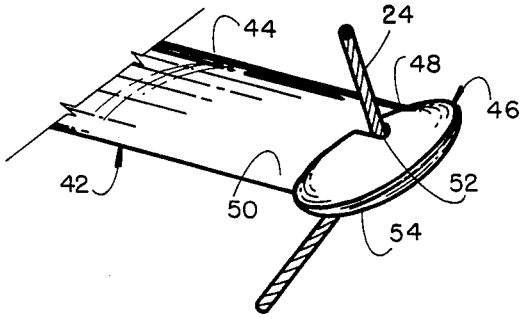
FIG. 7 is fragmentary, isometric view of the end portion of a sailboat spreader equipped with another embodiment of the protective caps of the invention.

In the embodiment of the invention shown in FIGS. 1–6, the cap 2 is in the form of a spherical body 40 bearing the slots and bores as recited and the spreader 4 in a round tubular member. In the embodiment shown in FIG. 7, the spreader 42 is a flattened columnar member 44 and the cap 46 is longer in the horizontal plane then in the vertical plane so that opening in the rear 48 of the cap 46 will accept the end 50 of the spreader 42. The cap 46 comprises slots 52, bores (not shown) and an arcuate front surface 54 as described in connection with the embodiment of FIGS. 1–6.

FIG. 1 illustrates how the new spreader caps 2 may be easily installed on a sailboat spreader 4 without need to move or remove the shroud 24. Installation is accomplished by removing the cotter pin 36 used to hold the shroud 24 in the spreader end 10. Then, spreader end 10 is inserted into the opening 6 in the cap 2 while the shroud enters the slots 16 and 20. Making sure the existing or new cotter pin 36 is straight, it is inserted through the first bore 26, through the hole 42 in the spreader end 10 and then into the second bore 30. The legs 38 of the cotter pin 36 are then spread apart in the chamfer 34. This locks the cap 2 in position on the spreader 4. At the same time the opened legs 38 of the cotter pin 36 are enveloped by the chamfer 34 so that they will not snag sails or lines that come in contact with the spreader 4.

The embodiments of the invention in which an exclusive property or privilege is claimed are defined as follows:

1. A protective cap for the end of a sailboat spreader which comprises:

an opening in the rear of said cap of a size such that said cap will fit snugly over said spreader end, an arcuate surface on the front of said cap, a first slot in one side of said cap that extends from the outer surface of said cap into said opening, a second slot in the side of said cap opposite to said first slot, said second slot extending from the outer surface of said cap into said opening, the longitudinal axes of said first and second slots being aligned, said first and second slots providing a space into which a shroud carried on the end of said spreader may enter so said cap may fit over the end of said spreader, a first bore through a side of said cap that extends from the outer surface of said cap into said opening, the longitudinal axis of said first bore being normal to said longitudinal axes of said slots, a second bore through a side of said cap that extends from the outer surface of said cap into said opening, the longitudinal axis of said second bore being normal to said longitudinal axes of said slots and aligned with said longitudinal axis of said first bore, and a chamfer on the outer end of said second bore, said first and second bores providing a passage through which a cotter pin may be inserted and retained by expanding the legs of said cotter pin in said chamfer.

2. A protective cap for the end of a sailboat spreader which comprises:

a spherical body, an cylindrical opening in the rear of said body of a size such that said cap will fit snugly over said spreader end, a first slot in one side of said body that extends from the outer surface of said body into said opening, a second slot in the side of said body opposite to said first slot, said second slot extending from the outer surface of said body into said opening, the longitudinal axes of said first and second slots being aligned, said first and second slots providing a space into which a shroud carried on the end of said spreader may enter so said cap may fit over the end of said spreader, a first bore through a side of said body that extends from the outer surface of said body into said opening, the longitudinal axis of said first bore being normal to said longitudinal axes of said slots, a second bore through a side of said body that extends from the outer surface of said body into said opening, the longitudinal axis of said second bore being normal to said longitudinal axes of said slots and aligned with said longitudinal axis of said first bore, and a chamfer on the outer end of said second bore, said first and second bores providing a passage through which a cotter pin may be inserted and retained by expanding the legs of said cotter pin in said chamfer.

3. The protective cap of claim 2 wherein said chamfer is a rectangular slot in the outer surface of said body into which said second bore extends.

* * * * *